United States Patent [19]

Struble

[11] 4,015,454

[45] Apr. 5, 1977

[54] LATCHING ASSEMBLY FOR CAP DOOR

[75] Inventor: Dale L. Struble, Reading Township, Hillsdale County, Mich.

[73] Assignee: Union Products, Incorporated, Sturgis, Mich.

[22] Filed: Mar. 29, 1976

[21] Appl. No.: 671,266

[52] U.S. Cl. ..... 70/2; 292/36; 292/150

[51] Int. Cl.[2] ..... E05C 1/12; E05C 21/00

[58] Field of Search ..... 292/2, 36, 150, 167, 292/32, 33, 1

[56] References Cited

UNITED STATES PATENTS

| | | | |
|---|---|---|---|
| 1,596,992 | 8/1926 | Ognowicz | 292/36 X |
| 1,922,062 | 8/1933 | Sullivan | 292/36 UX |
| 1,959,192 | 5/1934 | Bates | 292/2 X |
| 2,793,892 | 5/1957 | Hutterer | 292/36 |
| 3,953,061 | 4/1976 | Hansen | 292/5 |

*Primary Examiner*—Robert L. Wolfe

*Attorney, Agent, or Firm*—Woodhams, Blanchard and Flynn

[57] ABSTRACT

A latching assembly for latching the swingable door associated with a cap as mounted over the bed of a pickup truck. The latching assembly is activated by a manually rotatable handle mounted centrally of the lower edge of the door. The latching assembly includes a pair of elongated rigid rods which project outwardly toward the opposite sides of the door and have latching bolts mounted on the free ends thereof, which bolts are disposed for latching engagement with the adjacent side jams. A removable fastening element, such as a screw, coacts between each bolt and the respective rod for permitting the bolt to function either as a deadbolt or as a spring-bolt. When the fastening element is present, the bolt is rigidly secured to the rod and functions as a deadbolt so that the handle must be manually rotated to move the bolts during both opening and closing of the door. However, removal of the fastening element permits the bolt to be slidably displaced axially of the rod, due to the presence of a spring, so that the door can be closed and latched due to inward camming of the spring-bolt without requiring actuation of the handle.

10 Claims, 8 Drawing Figures

LATCHING ASSEMBLY FOR CAP DOOR

FIELD OF THE INVENTION

This invention relates to an improved latching mechanism for use in association with a cap door to permit use of same as either a spring-bolt or a deadbolt.

BACKGROUND OF THE INVENTION

It is a well-known practice to cover the bed portion of a pickup truck with a hood, commonly referred to as a cap, so as to form a closed storage compartment. Such caps are conventionally provided with a rear door which is hinged along the upper edge thereof and, when closed, coacts with the tail gate of the truck for closing the rearward end of the compartment. The cap door normally overlaps the upper edge of the tail gate so that the tail gate cannot be opened so long as the cap door is in a closed and latched condition. To latch the cap door in a closed position, there has been conventionally provided a latching mechanism having a pair of latch bolts disposed adjacent the opposite lower side edges of the door, which latch bolts coact with the adjacent side jams of the cap for holding the door closed. The known latching mechanisms have conventionally been of two types, the first being a deadbolt mechanism employing rigid rods having bolt members rigidly secured to the outer ends thereof and connected to the operating handle whereby activation of the handle was necessary to not only unlatch the door, but also to latch the door. This known deadbolt latching mechanism is preferred by many individuals since it cannot be released due to insertion of a tool or the like between the adjacent edges of the door and tail gate, thereby providing maximum security when the door is closed. However, this deadbolt mechanism is undesirable since it requires manual actuation of the handle in order to latch the door, which operation is normally disliked and in many instances inconvenient.

To avoid the above disadvantage, many individuals prefer to utilize a second type of latching mechanism employing spring-bolts which are automatically cammed inwardly during closing of the door and hence do not require manual actuation of the handle. This known spring-bolt latching mechanism has not, however, provided for maximum security of the compartment when the door is latched since such mechanisms normally utilize flexible elements, such as chains or cables, connected between the bolts and the actuating handle. By insertion of a tool or the like between the adjacent edges of the tail gate and door, these cables can be pulled downwardly so as to retract the bolts, thereby releasing the door and permitting unauthorized access into the compartment. Thus, while the deadbolt and spring-bolt latching mechanisms both possess distinct advantages, each also possess distinct disadvantages which have made the use of both types less than desirable.

A further disadvantage often experienced with the known spring-bolt latching mechanism occurs when the opposite side jams on the cap undergo additional separation after the cap has been installed on the truck, which separation may occur due to the impacts and forces imposed on the truck while traveling over rough highways. The known spring-bolt latching mechanism normally has only a limited bolt travel, such as in the order of one-quarter inch, so that if the side jams move outwardly by this amount, then the bolt release the jams and hence permit undesired and accidental opening of the door. This thus makes the latching mechanism prone to being accidentally released during useage of the truck. This also requires that the cap be installed on the truck with a high degree of accuracy in order to maintain the spacing between the side jams within rather narrow permissible limits.

In addition to the above-mentioned operational disadvantages, the use of two different types of latching mechanisms has also created undesirable problems since manufacturers have to manufacture two different types of latching mechanisms. This accordingly increases the overall cost of the mechanisms and also increases the problem of maintaining adequate inventories of both types. Further, when it is desired to switch from a deadbolt mechanism to a spring-bolt mechanism, or vice versa, such switch requires removal of the prior assembly and mounting of a totally new assembly, which is obviously undesirable both due to the substantial time involved and the necessity of buying a complete new mechanism.

Accordingly, it is an object of the present invention to overcome the above-mentioned disadvantages by providing an improved latching mechanism for a cap door, which mechanism can be easily converted for use as either a deadbolt or a spring-bolt without requiring any timely conversion or expensive replacement of parts.

More particularly, it is an object of this invention to provide an improved latching mechanism, as aforesaid, which utilizes the same basic structure for use as either a spring-bolt or a deadbolt, which structure incorporates a removable fastening element, such as a screw, which can be added to or removed from the structure to permit the mechanism to function as a deadbolt or a spring-bolt, respectively.

A further object of this invention is to provide an improved latching mechanism, as aforesaid, which possesses an improved camming relationship between the spring-bolts and the side jams so as to permit the latching mechanism to successfully operate and maintain a latched relationship with the side jams over a rather large dimensional range, whereby the cap door can be securely latched to the side jams even though the side jams may relatively move outwardly away from one another through a substantial distance either due to faulty installation or due to the application of forces thereon.

A still further object of this invention is to provide an improved latching mechanism, as aforesaid, which provides for increased security of the cap even when the mechanism is used as a spring-bolt since the spring-bolt mechanism possesses features normally previously possessed only by a deadbolt mechanism, thereby effectively preventing unauthorized opening of the door.

Other objects and purposes of the invention will be apparent to persons familiar with structures of this type upon reading the following specifications and inspecting the accompanying drawings.

Figure 1:
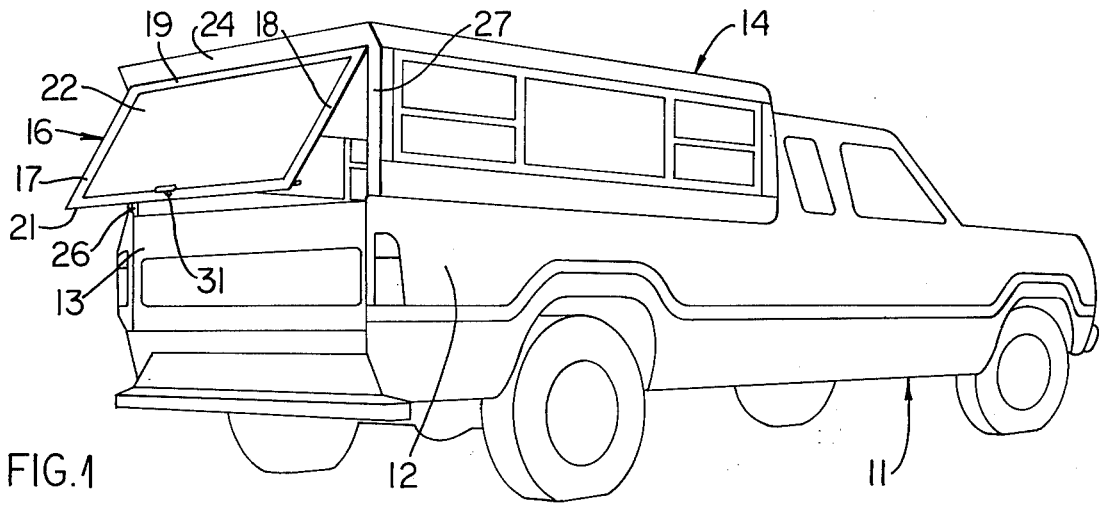
FIG. 1 is a perspective view of a pickup truck having a cap mounted over the bed thereof.

Certain terminology will be used in the following description for convenience in reference only and will not be limiting. For example, the words "upwardly," "downwardly," "leftwardly" and "rightwardly" will refer to directions in the drawings to which reference is made. The words "inwardy" and "outwardly" will refer to directions toward and away from, respectively, the goemetric center of the mechanism and designated parts thereof. Said terminology will include the words specifically mentioned, derivatives thereof and words of similar import.

SUMMARY OF THE INVENTION

The objects of the present invention are met by a latching mechanism for a cap door wherein a rotatable handle is connected to an actuating lever, which lever is pivotally connected to a pair of elongated rigid rods which project outwardly toward the opposite side edges of the door.

A bolt member is positioned on the free end of each rod and is disposed for coaction with an adjacent side jam. A spring is captivated between each bolt and the respective rod for urging the bolt axially outwardly of the rod. The bolt is mounted for limited axial sliding movement with respect to the rod so as to function as a conventional spring-bolt, whereupon the bolt is cammed inwardly and then automatically extends to latchingly engage the side jam during closing of the door, thereby not requiring manual rotation of the handle. However, by addition of a simple fastening device, such as a screw, the bolt can be fixedly locked to the rod so as to function as a deadbolt, thereby requiring manual rotation of the handle to permit closing and hence latching of the door. The rigid rods as connected between the actuating lever and the bolts effectively prevent unauthorized release of the latching mechanism since, even if these rods can be reached by inserting a tool between the adjacent edges of the door and tail gate, they cannot be displaced to permit release of the bolts.

DETAILED DESCRIPTION

FIG. 1 illustrates a conventional pickup truck 11 having a bed 12, the rear of which is provided with a conventional tail gate 13 hinged along the lower edge so that the tail gate can be swingably lowered into a substantially horizontal opened position. The bed of the pickup is closed by a conventional cap 14 which extends throughout the length of the bed and is secured to the upper edges of the sidewalls thereof. The cap 14 has, at the rear thereof, a swingable door 16 which can be moved into an open position to permit access into the interior compartment defined between the bed and the cap.

Figure 2:
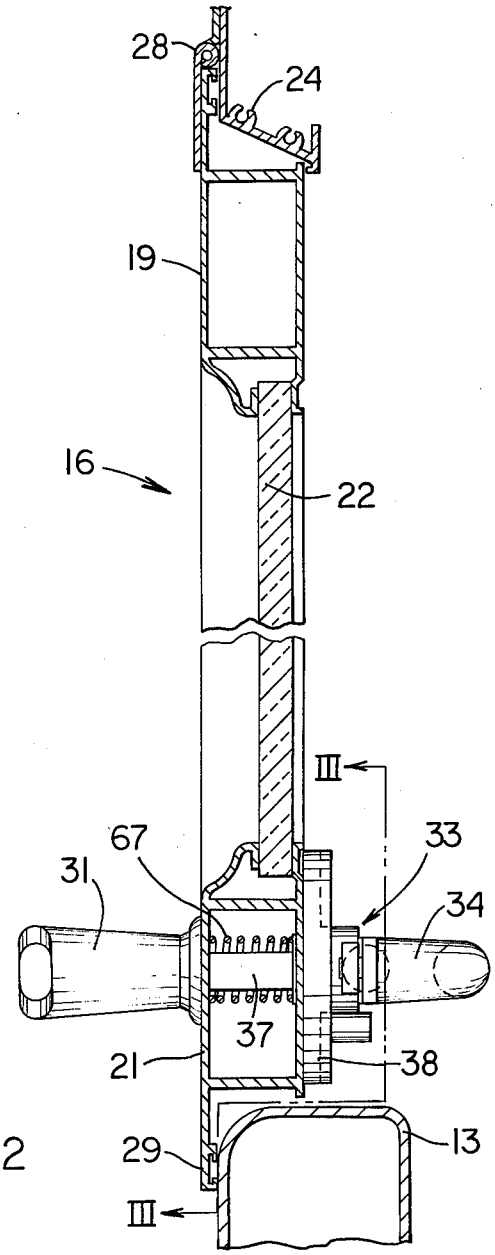
FIG. 2 is an enlarged, fragmentary, elevational, cross-sectional view of the cap door in its closed position.

The door 16, as shown in FIGS. 1 and 2, includes a substantially rectangular frame formed by substantially parallel side frame elements 17 and 18 interconnected by top and bottom frame elements 19 and 21, respectively. These framing elements support a panel 22, such as a conventional glass or plastic window.

The rear of the cap 14 defines therein an opening which is closed by the door 16, which opening is defined by a top jam 24 and a pair of substantially parallel side jams 26 and 27, which jams are all fixedly associated with the cap 14. The top frame element 19 is connected to the top jam 24 by a hinge 28 (FIG. 2) which is preferably a pianotype hinge and extends longitudinally throughout the complete length of the door. The side frames 17 and 18 are adapted to abut against the side jams 26 and 27, respectively, when the door is in its closed position. When in this closed position, the bottom frame element 21 is positioned directly adjacent and over the upper edge of the tail gate 13. In addition, the bottom frame element 21 has a downwardly depending flange 29 which overlaps the exterior surface of the tail gate 13, as shown in FIG. 2, for preventing opening of the tail gate when the door 16 is in a closed and latched condition.

The door 16 has a conventional T-shaped exterior handle 31 mounted centrally of the lower frame element 21, which handle 31 is interconnected to an interior latching assembly 33 for activating and controlling same. The exterior handle 31 has a conventional key-actuated lock associated therewith which prevents rotation of the handle 31 when in a locked condition, so that the handle 31 can be rotated to actuate and release the latching mechanism 33 only when the lock is released by actuation of a key. Handles incorporating key-type locking devices are well known.

There is additionally provided a further handle 34 positioned interiorly of the door and connected to the latching mechanism 33 to permit activation thereof from the interior compartment of the cap.

The overall structure explained above is conventional except for the details of the latching mechanism, as explained hereinafter.

Figure 3:
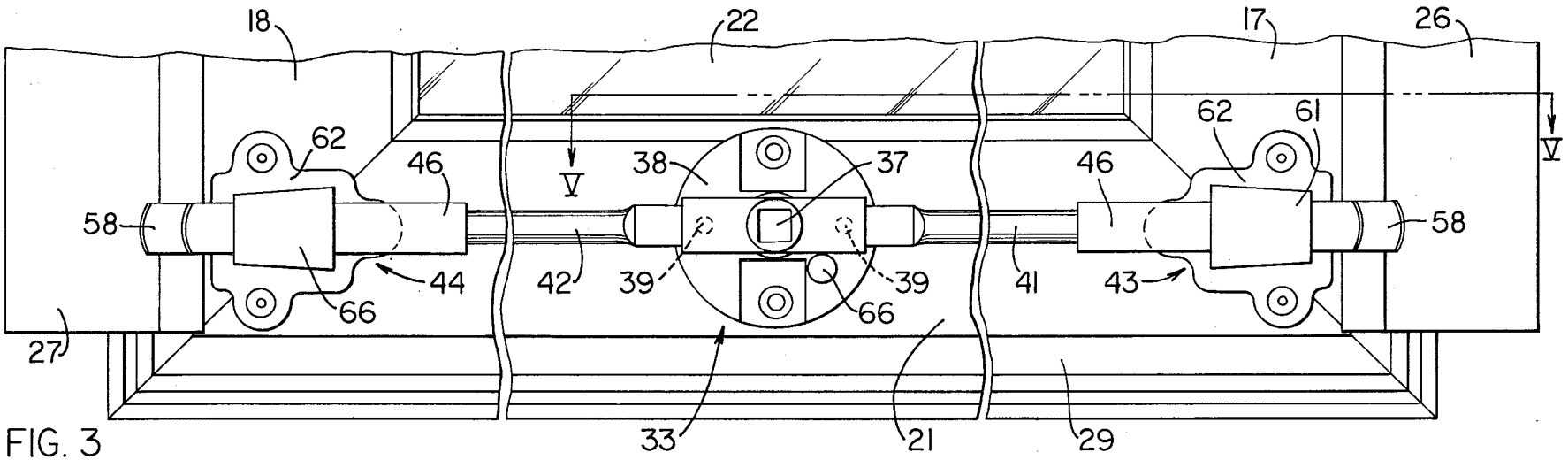
FIG. 3 is a fragmentary view taken substantially along the line III—III in FIG. 2 and showing the latching mechanism in its latched position.
Figure 4:
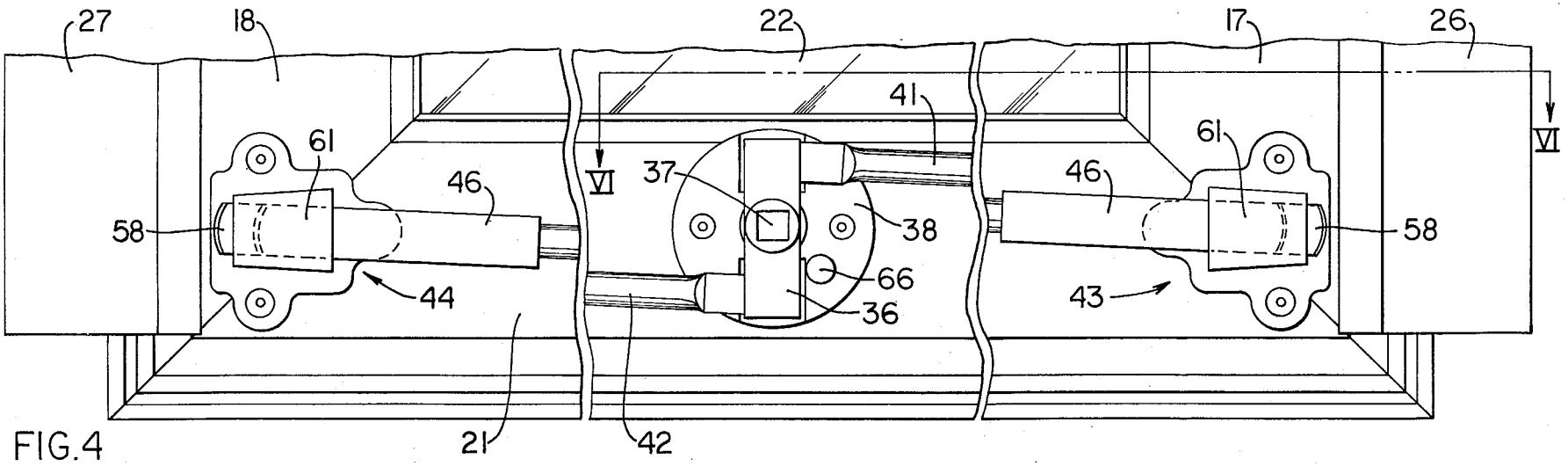
FIG. 4 is a view similar to FIG. 3 but showing the latching mechanism in its released position.

The latching mechanism 33 includes an elongated cam or lever 36 nonrotatably connected substantially at the midpoint thereof to the inner end of a shaft 37, which shaft is nonrotatably connected to the exterior handle 31 and is rotatably supported on a plate 38 fixed to the inner surface of the lower frame element 21. The outer free ends of lever 36 are pivotally connected, as by pivot pins 39, to a pair of elongated rigid rods 41 and 42 which extend outwardly in opposite directions along the bottom frame element 21. The rigid rods 41 and 42 in turn have bolt assemblies 43 and 44, respectively, provided on the outer ends thereof. The bolt assemblies 43 and 44 are disposed to latchingly engage the side jams 26 and 27, respectively, as shown in FIG. 3, to thereby lock the door 16 in its closed position. However, as shown in FIG. 4, the bolt assemblies 43 and 44 are retractable out of engagement with the side jams when opening of the door 16 is desired.

The bolt assemblies 43 and 44 are identical so that only the assembly 43 will be described in detail.

The bolt assembly 43 includes an elongated bolt member 46 which is preferably molded of a plastics material and has a cylindrical opening 47 in which is slidably accommodated the outer end of the rod 41. The bolt member 46, which in cross-section is preferably of a rectangular configuration, has an elongated slot 48 formed in one side thereof and disposed in communication with the opening 47. The end of rod 41 has a pair of axially spaced openings 49 and 51 therein, and a screw 52 is threadably engaged within the opening 49 so that the head of a screw 52 is accordingly accommodated within the slot 48 to thereby prevent relative rotation between the bolt member 46 and the rod 41. The other opening 51 is also adapted to have a screw 53 threadably engaged therein, as shown by dotted lines in FIG. 8, whereby when both screws 52 and 53 are utilized, then the bolt member 46 is fixed axially with respect to the rod 41 due to the heads of the screws 52 and 53 being disposed so as to abut against the walls which define the opposite ends of the slot 48.

The bolt member 46 has a further slot 54 formed therein and extending transversely therethrough, which slot has a conventional coil-type compression spring 56 positioned therein. The forward end of spring 56 bears against an end wall 57 formed on the bolt member, whereas the rearward end of spring 56 is engaged with the forward end of the rod 41, being fixed thereto as by soldering or the like. The bolt member 46 also has a tapered surface 58 formed on the free end thereof, which tapered surface functions as a cam and slopes inwardly toward the rearward side of the bolt member. This surface 58 is also preferably slightly round when viewed in the vertical direction.

To slidably guide the bolt member 46, there is provided a tubular guide portion 61 fixedly associated with a bracket 62, which bracket is fixed to the adjacent side frame element 17. Guide portion 61 has an opening therethrough of substantially rectangular cross-section so as to permit slidable displacement of the bolt member 46 while effectively preventing relative rotation thereof. The guide portion 61 has a first opening 63 (FIG. 8) adjacent the outer end thereof, which opening snugly but slidably accommodates the bolt member. The opening 64 at the rearward end of the guide portion is, however, of larger cross-section when viewed vertically so as to permit the bolt member and its associated rod to undergo limited angular movement as caused by rotation of the lever 36 between the two positions illustrated in FIGS. 3 and 4.

OPERATION

When the actuating lever 36 is in the position illustrated in FIG. 3, then the latching mechanism 33 is in a closed or latched position such that the bolt members 46 overlap the side jams 26 and 27 for holding the door in a closed position. When in this closed position, one end of lever 36 effectively abuts against a stop pin 66 whereby the lever 36 is prevented from further rotation in one direction, namely the clockwise direction as viewed in FIG. 3. However, by rotating the lever 36 through an angle of about 90° (counterclockwise in FIG. 3), this causes the latch mechanism to assume the position shown in FIG. 4, in which position the latch bolts are retracted inwardly so that they no longer overlap the side jams 26 and 27, whereby the door is thus in an unlatched condition. When in this unlatched condition, further counterclockwise movement of lever 36 is prevented due to the other end of the lever contacting the stop pin 66. This single stop pin 66 thus effectively limits the lever 36 for rotation between two positions which are spaced apart by an angle of about 90°, which two positions define the latched and unlatched positions of the mechanism.

While the above description merely indicates the general operation of the latch mechanism between the latched and unlatched positions, the latching mechanism of the present invention can also be modified to function either as a dead-bolt or as a spring-bolt merely by adding or removing the second screw 53, respectively.

Figure 8:
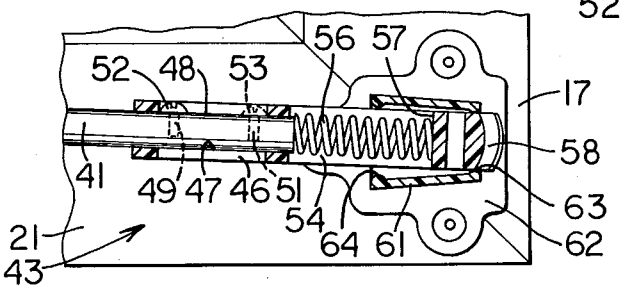
FIG. 8 is a fragmentary sectional view taken substantially along the line VIII—VIII in FIG. 6.

For example, when it is desired to have a deadbolt-type latching mechanism, then the second screw 53 is threadably engaged within the opening 51. With the presence of both screws 52 and 53 positioned within the slot 48, as shown in FIG. 8, the heads of these screws are positioned directly adjacent the end walls which define the opposite ends of the slot 48, so that the bolt member 46 is thus rigidly secured with respect to the rod 41 and hence cannot slidably move therealong. The spring 56 is thus rendered inactive. Accordingly, when connected as a deadbolt, opening of the door requires turning of the handle 31 and hence a 90° rotation of the lever 36 from the position shown in FIG. 3 into the position shown in FIG. 4, thereby retracting the bolts 46 from behind the side jams 26 and 27. The door 16 can then be manually swung outwardly and upwardly into an open position. Since the handle normally has a torsion spring 67 (FIG. 2) associated therewith, which spring 67 always returns the handle and hence the lever 36 into the latching position shown in FIG. 3, manual release of the handle when the door is open causes the latching mechanism to return to the condition shown in FIG. 3 wherein the rods 41 and 42 are aligned and the bolts 46 project outwardly beyond the side frame members 17 and 18. Thus, when it is desired to close the door, the handle 31 must again be manually rotated to turn the lever 36 into the unlatched position shown in FIGS. 4 and 6, which handle must be maintained in this position until the door is swung inwardly into its fully closed position, at which time the handle can then be released so that spring 76 will return the latch mechanism into the latched position shown in FIGS. 3 and 5. This deadbolt latching mechanism accordingly requires a positive actuation of the handle during both the opening and closing of the door.

Figure 5:
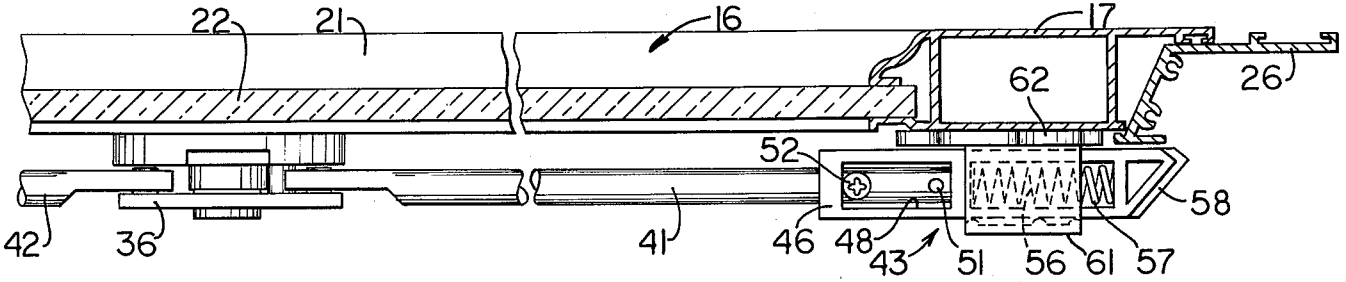
FIG. 5 is a sectional view taken substantially along the line V—V in FIG. 3.
Figure 6:
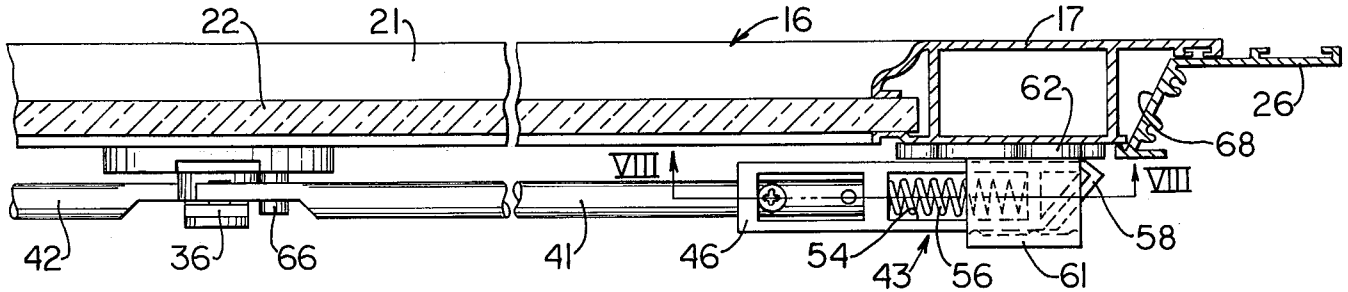
FIG. 6 is a sectional view taken substantially along the line VI—VI in FIG. 4.
Figure 7:
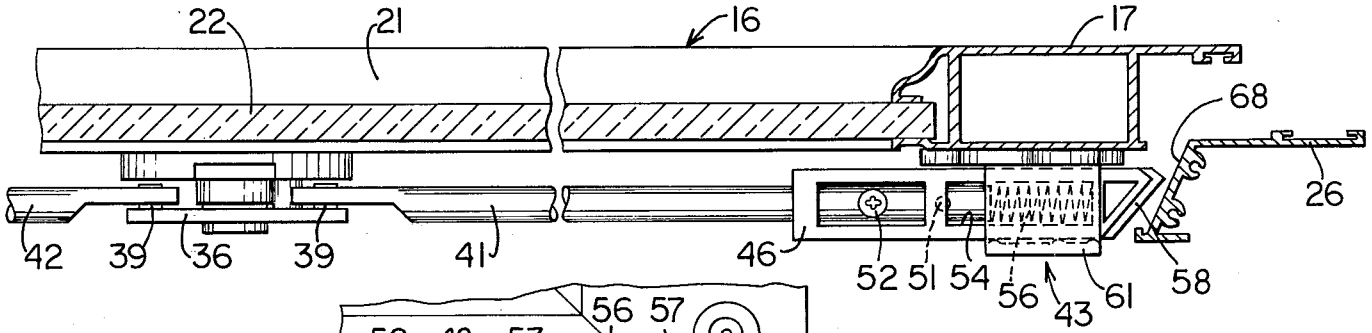
FIG. 7 is a view similar to FIGS. 5 and 6, but showing the cam-actuation of the spring-bolt during closing of the door.

When it is desired to incorporate a spring-bolt within the latching mechanism 33, then the screw 53 associated with each of the bolt assemblies 43 and 44 is removed. The bolt members 46 are thus retained on the ends of the rods 41 and 43 solely by the remaining screw 52. This screw, however, permits the bolt members 46 to be slidably displaced relative to the respective rod. Due to the presence of the spring 56, each bolt member 46 is urged outwardly of the rod so that the head of screw 52 abuts against the rearward end of the slot 48, as shown in FIGS. 5 and 6. With the latch bolt 46 spring-urged outwardly into this outermost position, same projects outwardly a sufficient extent to project behind the adjacent side jams 26 and thereby latch the door when the operating lever 36 is in its latching position as shown in FIGS. 3 and 5, in which position the actuating lever 36 and the rods 41 and 42 are substantially aligned. When release of the door is desired, then the handle 31 is rotated to cause the lever 36 to be rotated into the position shown in FIGS. 4 and 6, in which position the latch bolts are retracted sufficiently to clear the adjacent side jams 26 and 27, whereupon the door can then be swung manually outwardly and upwardly into an open position. When in the open position, the handle can be manually released, whereupon spring 67 will again return the lever 36 and the rods 41 and 42 into their aligned positions as shown in FIGS. 3 and 5. However, when it is desired to again close the door, it is not necessary to again turn the handle since the spring-urged bolts 46 will automatically cam inwardly as the door is being closed. For example, when the door approaches its closed position, then the cams 58 formed on the free ends of the bolts 46 engage the cam surfaces 68 formed on the adjacent side jams 26 and 27. These surfaces 68 cam the latch bolts 46 axially inwardly along the respective rods 41 and 42, which inward displacement of the bolts is in opposition to the urging of the springs 56, and is permitted due to the slidable guided displacement of the screw heads 52 within the slots 48. When the latch bolts move past the inner edge of the side jams, then the springs 56 again urge the bolt members 46 outwardly so that they extend behind the side jams, substantially as shown in FIG. 5, thereby latching the door in its closed position.

Thus, the latching mechanism 33 of the present invention is highly desirable since, by inserting the second screws 53, the latching mechanism is provided with deadbolts so as to require a positive actuation of the handle 31 in order to permit closing and latching of the door. However, by removing these second screws 53, then the latching mechanism is provided with springbolts so that the door can be moved into and automatically latched in its closed position without requiring manual actuation of the handle.

The latching mechanism 33, and its coaction with the side jams 26 and 27, also permits the spring-urged latch bolts 46 to maintain a latched engagement with the side jams 26 and 27 even when the transverse spacing between these side jams varies over a substantial range, such as in the order of one and one-half inches. For example, due to the presence of the camming surface 68 on each side jam, and its coaction with the camming surface 58 formed on the nose of each latch bolt, the latch bolt 46 can be provided with a rather large axial movement with respect to its rigid rod 41, which axial movement may be in the order of three-quarters inch or larger. Thus, even if the side jam 26 is displaced outwardly away from the door through a substantial distance, such as in the order of one-half inch, which displacement may occur either during installation of the cap on the truck or due to deformation forces imposed by rough highways, the latch bolt will still extend through a sufficient distance so as to overlap behind the side jam and create a latched engagement therewith substantially as illustrated in FIG. 5. In the illustrated embodiment, the camming surface 68 on the side jam preferably extends at an angle in the range between 25° and 35°, whereas the camming surface 58 is preferably of a slightly steeper angle, such as in the order of from 35° to 45°. This relationship, in combination with the permissible axial displacement of the bolt on its rigid rod, thus permits substantial variation with respect to the dismensional tolerance between the cap door and the adjacent side jams, without preventing the latching mechanism from being moved into latched engagement with the side jams.

Although a particular preferred embodiment of the invention has been disclosed above for illustrative purposes, it will be understood that variations or modifications thereof which lie within the scope of the appended claims are fully contemplated.

The embodiments of the invention in which an exclusive property or privilege is claimed are defined as follows:

1. In a cap door having a pair of spaced and substantially parallel frame elements, one of said frame elements being adapted to be hingedly connected to a cap, a handle rotatably supported on the other frame element and disposed adjacent the exterior side of the door, and a latching mechanism mounted on the door and positioned adjacent the interior side of said other framing member, said latching mechanism being interconnected to and activated by said rotatable handle, the improvement wherein said latching mechanism includes:

a rotatable lever drivingly interconnected to and rotated by said handle;

an elongated rigid rod extending along one side of said door and having one end thereof pivotally connected to said lever;

guide means fixed to said door and coacting with said rod adjacent the other end thereof for slidably guiding same; and bolt means mounted on the other end of said rod and being positioned to project outwardly beyond an edge of the door so as to latchingly engage a part of the cap, said bolt means including a bolt member slidably mounted on the other end of said rod and spring means coacting between said bolt member and said rod for normally urging said bolt member axially outwardly of said rod;

said bolt means further including conversion means associated with at least one of said rod and bolt member for permitting said bolt member to be rigidly fixed relative to said rod when it is desired to have said latching mechanism function as a deadbolt.

2. A door according to claim 1, wherein said conversion means includes an opening formed in one of said rod and bolt member, said opening being adapted to receive therein a removable fastening element for fixedly connecting said bolt member to said rod.

3. A door according to claim 1, including a second elongated rigid rod pivotally connected to said lever and projecting outwardly in an opposite direction from said first rod, second bolt means mounted on the outer end of said second rod, said second bolt means being identical to said first-mentioned bolt means, and said lever being pivoted intermediate the ends thereof and said rods being pivotally connected to said lever adjacent the opposite free ends thereof.

4. A door according to claim 1, wherein said bolt member has a cylindrical opening therein in which is slidably accommodated the other end of said rigid rod, said bolt member having an elongated slot formed in the side wall thereof, said slot opening inwardly so as to expose said rod member, said rod member having a radially extending projection formed thereon and projecting into said elongated slot, whereby said projection in cooperation with said slot prevents relative rotation between said bolt member and said rod member while permitting limited axial displacement therebetween.

5. A door according to claim 4, wherein said rod has a second projection removably supported thereon and projecting radially therefrom, said second projection being axially spaced from said first-mentioned projection, said second projection also being confined within said axially elongated slot whereby said projections axially fix said bolt member relative to said rod.

6. A door according to claim 5, wherein said second projection comprises a threaded fastening member which can be removed from said rod to permit relative axial displacement between said rod and said bolt member.

7. A door according to claim 6, wherein the outer free end of said bolt member is provided with a tapered camlike surface thereon for automatically retracting the bolt member during closing of the door when the latching mechanism is being used as a spring-bolt.

8. A door according to claim 7, wherein said door is disposed so that said frame elements extend substantially horizontally and the upper frame element is hingedly connectable to the cap, the handle being rotatably supported on the lower frame element substantially adjacent the midpoint thereof, said rod projecting substantially horizontally toward one side edge of the door, and a second elongated rigid rod being hingedly connected to the lever and projecting substantially horizontally toward the other side of the door, and second bolt means mounted on the outer end of said second rod, said second bolt means being substantially identical to said first-mentioned bolt means, said rods being pivotally connected to said lever at locations which are equally radially spaced from the pivot axis thereof but on diametrically opposite side thereof so as to cause simultaneous extension or retraction of both said first-mentioned and said second bolt means.

9. A door according to claim 3, including a pair of elongated and substantially parallel side jams stationarily positioned adjacent the opposite edges of said door, each of said side jams being disposed for cooperation with and engagement by one of said bolt means, each of said bolt means having a tapered surface formed on the free end thereof, and each of said side jams having a tapered face disposed for engagement with the adjacent bolt means for camming said bolt means inwardly when the door is being moved into a closed position.

10. A door according to claim 9, wherein the tapered face on said side jam defines an angle of between 25° and 35° with respect to a plane which is perpendicular to the hinge axis of the door, and wherein the tapered surface on said bolt means extends at an angle of between 35° and 45° with respect to said plane.

* * * * *